United States Patent [19]

Collier

[11] 4,348,680

[45] Sep. 7, 1982

[54] MICROWAVE ANTENNA WITH SINUOUS WAVEGUIDE FEED

[76] Inventor: Donald C. Collier, Rte. 1, Box 80C, Plano, Tex. 75074

[21] Appl. No.: 228,558

[22] Filed: Jan. 26, 1981

[51] Int. Cl.[3] ..... H01Q 13/00

[52] U.S. Cl. ..... 343/778; 343/776; 343/854

[58] Field of Search ..... 343/776, 777, 778, 854, 343/895

[56] References Cited

U.S. PATENT DOCUMENTS

| | | | |
|---|---|---|---|
| 3,008,141 | 11/1961 | Cohn et al. | 343/776 |
| 3,039,097 | 6/1962 | Strumwasser et al. | 343/854 |
| 3,434,139 | 3/1969 | Algeo | 343/778 |

OTHER PUBLICATIONS

Watkins et al., "Phased-Scanned Linear Array Antenna", International Conference on Radar—Present and Future, London, England, Oct. 23-25, 1973, pp. 81-87.

*Primary Examiner*—David K. Moore

*Attorney, Agent, or Firm*—Duckworth, Allen, Dyer & Pettis

[57] ABSTRACT

An electronically scannable microwave antenna having a minimum physical size suitable for mounting in the leading edge of an aircraft wing or the like. A multiplicity of waveguide radiators form a horizontal array having a common horn for limiting the vertical beamwidth. The radiators are fed by a common continuous sinuous waveguide having a plurality of coupling apertures for feeding the radiators in phase. The sinuous waveguide includes coupling sections above and below the radiators to minimize the horizontal size of the antenna. The coupling apertures are formed to provide a linear Taylor distribution of energy to the radiators to produce a narrow horizontal beamwidth having very small side lobes. The antenna beam is scannable in azimuth by varying the frequency of the input signal or by periodically varying the phase of a constant frequency input signal at each radiator.

14 Claims, 8 Drawing Figures

A
B
C
D
S
10,11,12,16

TRIANGULAR WAVE GENERATOR
POWER AMP

MICROWAVE ANTENNA WITH SINUOUS WAVEGUIDE FEED

BACKGROUND OF THE INVENTION

1. Field of the Invention

The present invention relates generally to airborne radar antennas and more particularly to an electronically scannable antenna especially adapted for mounting in the wing of small aircraft.

2. Description of the Prior Art

Weather avoidance radar systems are widely used in multi-engine aircraft and have, in the past, utilized some form of reflector antenna such as a parabolic or a flat plate dish antenna which may be scanned mechanically. Due to the size of such antennas and the requirement for mechanical scanning, it is common to mount such antennas in a radome attached to the nose of multi-engine aircraft. However, in most single engine aircraft, there is no nose section available for mounting a weather avoidance scanning radar antenna since this is the location of the aircraft engine. Due to the large number of weather-related aircraft accidents involving small private planes, a number of attempts have been made to install weather avoidance radar scanning antennas in the leading edge of the wing of single engine aircraft. For example, RCA Avionics Systems has developed an X-band weather radar, known as the WeatherScout I, which uses a truncated parabolic scanning antenna which may be installed in the leading edge of an aircraft wing. However, this solution has been marginally acceptable. The moving parts of the mechanically scanned antenna are subject to freezing problems, frequent maintenance and repair, and normal wear of the mechanisms. The antenna performance is not completely satisfactory. The azimuth side lobes are only about 18 dB down from the main lobe and 13 dB down in elevation. The beamwidth is about 8° which limits the resolution.

The requirement to mount the scanning antenna in the leading edge of the wing suggests that a phased array which can be electronically scanned presents the greatest promise. However, the size of known phased arrays which will produce the necessary narrow beamwidth antenna have been found to be excessive. One type of electronically scanned array has appeared which has a suitable configuration and is described in U.S. Pat. Nos. 3,008,141 to Cohn, et al and 3,039,097 to Strumwasser, et al. The antenna arrays in this prior art are formed from folded waveguide sections having multiple radiating ports arranged such that the relative phase of the radiated energy from the ports will determine the angle of the radiated beam and the number of ports and distribution of amplitudes of energy from the ports will determine the beamwidth. In general, these waveguide antennas have certain fixed selected lengths of waveguide associated with each radiating port such that a zero azimuth beam is produced when all radiated waves are in phase. The frequency of the input electromagnetic energy is varied linearly over a selected range resulting in phase shifts with respect to each radiating port. Thus, a proper selection of scan frequencies will permit scanning of the beam in azimuth.

In the Strumwasser patent, radiation takes place from slots cut in the top surfaces of the multiplicity of parallel waveguide sections connected at each end with 180° E-bends producing a narrow beam in azimuth. The radiation from the series of waveguide slots is reflected from a curved plate which serves to limit the vertical beamwidth. The spacings between the parallel waveguide sections disclosed in these patents are such that a very long array is required to obtain a sufficiently narrow azimuth beam for the desired resolution. Furthermore, the distance between the radiating slots is, by necessity on the order of one wavelength which produces a satisfactory pattern when the beam has a zero azimuth angle. However, for scan angles much greater than 25° or so, this wide spacing produces severe side lobes.

In the Cohn antenna, a similar folded waveguide structure is disclosed with apertures in the waveguide that couple into an array of closed-end waveguide sections having small flared horns at the outer, open ends. Thus, radiation takes place from the parallel array of flared horns. As in the Strumwasser antenna, the radiating sections are widely spaced. This is necessary to accommodate the flared portion of the radiating horns, and center-to-center spacings of about one wavelength are found. Although the curved plate reflector of Strumwasser is eliminated, the length of the array for a very narrow radiated beam is also excessive for aircraft application and the side lobe problem exists for large scan angles.

The excessive size and poor side lobe characteristics of these known scanning electronically scanned arrays make them unsuitable for wing mounting in small aircraft.

SUMMARY OF THE INVENTION

The present invention is an improved electronically-scanned phased array antenna using a novel folded waveguide phasing and feed configuration which greatly reduces the length of the array for a given beamwidth. The invention is termed a sinuous waveguide antenna which is descriptive of the folding technique developed for feeding the radiating elements. Since the phased array type antenna driven by a frequency swept source depends on the physical length of the feed from radiating element to radiating element, the number of bends in the waveguide is not critical as long as the looses due to each bend are not excessive. In the present invention, a waveguide is folded such as to provide an upper array of parallel waveguide sections and a lower array of parallel waveguide sections having 180° H-bends at the rear of the antenna which connects straight upper sections to straight lower sections of waveguide. At the front of the antenna 180° E-bends connect alternate pairs of upper straight waveguide sections and similarly, 180° E-bends connect alternate pairs of lower straight waveguide sections. The net result is a continuous sinuous waveguide run having an upper bank of parallel straight sections, a lower bank of parallel straight sections, and which makes 180° vertical H-plane turns at the rear and 180° horizontal E-plane turns at the front. An input is provided at one end of the waveguide run and a terminating section at the other end of the waveguide run. In order to limit the volume of the antenna, the upper straight parallel sections of waveguide and the lower straight parallel sections of waveguide have their broad walls contiguous. A special 180° E-bend which can produce the required coupling of the contiguous waveguide sections yet has very low losses makes such construction feasible. At the front of the array of upper and lower sections, a series of parallel short waveguide sections having their broad walls contiguous, are disposed between the upper and lower banks of straight waveguide sections, and contiguous therewith. These sections are radiating elements and are closed at the rear end and open at the front end with the open ends projecting slightly beyond the front of the array. Each section is coupled to a straight section of the feed waveguide by means of slots through the contiguous narrow walls of the radiating element and the straight feed waveguide.

Thus, the array of open ended radiating elements will radiate electromagnetic energy which, depending on the amplitude and phase of the radiation from each element, will combine to produce the desired narrow beamwidth in azimuth. For example, an antenna in accordance with the invention having 30 radiating elements can produce a 4° beamwidth. A simple horn flared in the vertical plane and common to all of the radiating elements will limit the vertical beamwidth to thereby produce a fan shaped radiation pattern.

Advantageously, the contiguous spacing of the radiating waveguide elements not only provides a minimum volume for the array but also contributes to extremely small side lobes even at extreme angles of sweep since the center-to-center spacing is less than one wavelength. The lengths of the straight waveguide sections forming the sinuous waveguide are selected such that, at a desired center frequency, the radiated electromagnetic waves from the radiating elements are all in phase, producing a zero azimuth beam. As the frequency is swept above and below the center frequency, the energy from each radiating element is equally shifted in phase and therefore swings the beam to the right or to the left, depending on the direction of frequency change. As may now be recognized, the width of the array from the input end to the termination end may be about ¼ to ½ that for the above noted prior art waveguide antennas for comparable beamwidths since there is no lateral spacing between the folded straight feed waveguide sections. The feature reduces the length by about one-half, and the use of an upper and lower bank of sections reduces the length by another half.

An alternative version of the invention utilizes the same feed waveguide and radiating structure, and additionally includes a ferrite phase shifter on the feed section associated with each radiating element. In this version, a fixed frequency is used and all of the phase shifters are driven in parallel from a power amplifier to produce a linearly changing, equal phase shift of the energy radiated from each radiating element which also produces the desired scanning beam.

It is therefore a principal object of the invention to provide a folded waveguide antenna array having a minimum physical volume which can be electronically scanned to produce a very narrow beam scanning antenna array.

It is another object of the invention to provide a compact antenna array utilizing a sinuous waveguide construction in which a continuous waveguide is folded horizontally and vertically to produce a maximum length of the waveguide in a minimum volume.

It is yet another object of the invention to provide a small volume, electronically scannable antenna using waveguide radiating elements in which the amplitude distribution of the energy from the radiating elements is controlled to provide very low side lobes of radiated electromagnetic energy.

It is still another object of the invention to provide a compact narrow beamwidth antenna, electronically scannable in the azimuth plane and having a horn structure to limit the beamwidth in the vertical plane.

It is a further object of the invention to provide a compact waveguide type antenna in which a narrow beam is scanned in azimuth by linearly sweeping the frequency of the input of electromagnetic energy.

It is still a further object of the invention to provide a waveguide antenna array having a narrow beamwidth radiation pattern in which the radiated beam can be electronically scanned by means of phase shifters associated with the waveguide array.

These and other objects and advantages of the invention will be apparent from the following detailed description when read in conjunction with the drawings.

BRIEF DESCRIPTION OF THE PREFERRED EMBODIMENT

Figures 1, 2, 3:
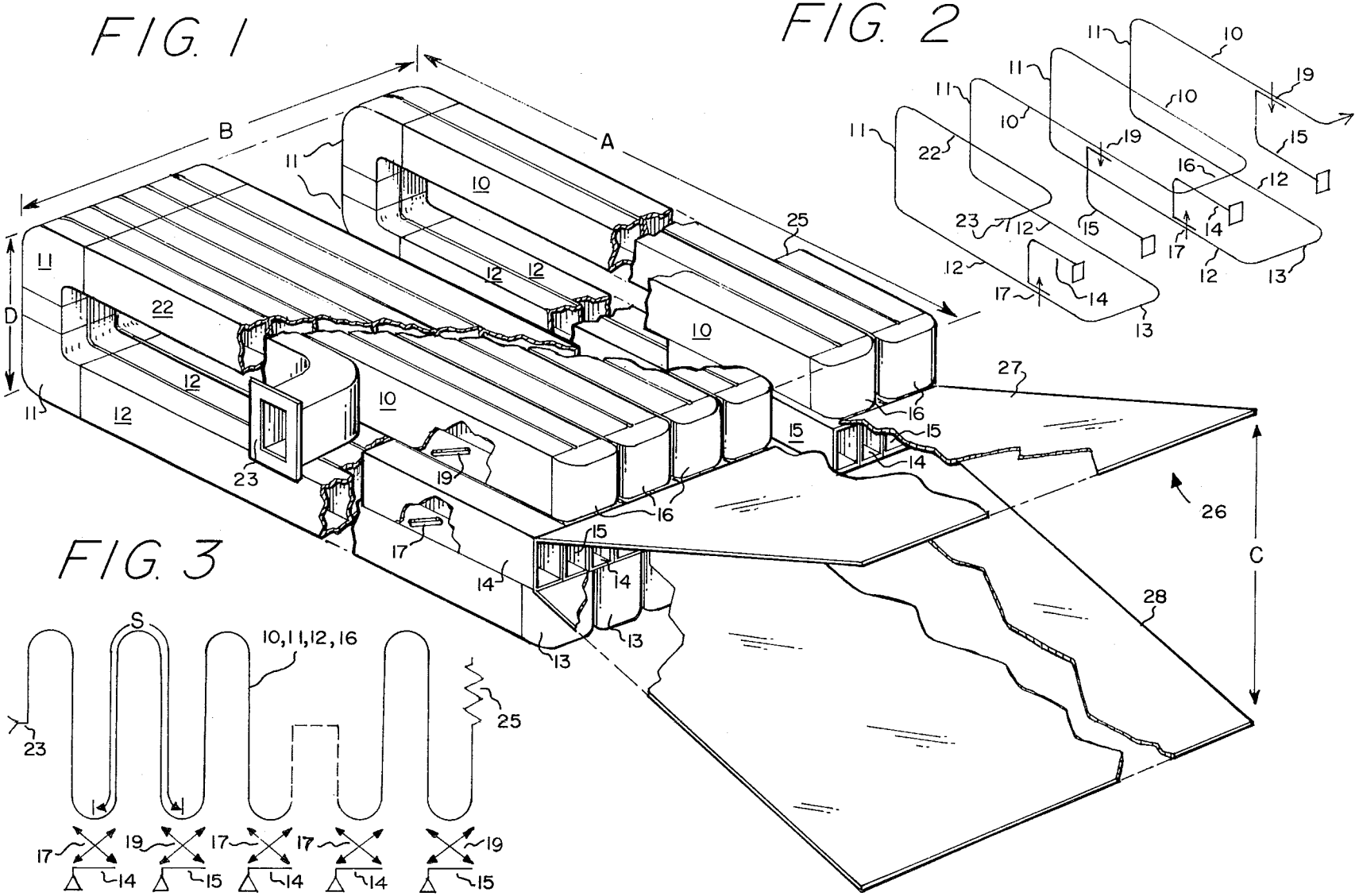
FIG. 1 is a partial and cutaway perspective view of the scannable waveguide of the invention.
FIG. 2 is a partial schematic diagram showing the waveguide folding scheme of the antenna of FIG. 1.
FIG. 3 is an electrical schematic diagram of the antenna of FIG. 1.

The waveguide type antenna of the present invention is particularly adaptable for a narrow beam scanning antenna to be used in restricted spaces such as in the leading edge of an aircraft wing. The antenna is referred to as a sinuous waveguide antenna for reasons that will be apparent with reference to FIG. 1. The waveguide antenna is formed by a novel arrangement of waveguide sections having an input end 23 and a terminating end 25, with a continuous run of rectangular waveguide sections therebetween forming a feed for a set of radiating sections 14, 15. The mechanical configuration is apparent from FIG. 1 and the mechanical schematic representation in FIG. 2. The structure comprises a multiplicity of upper straight waveguide sections 10 in a closely spaced parallel array, connected to a complementary set of closely spaced lower straight waveguide sections 12. The waveguides are disposed with the H-planes parallel. An upper straight section 10 is coupled at the rear of the array to the lower straight section 12 immediately therebelow by a 180° H-bend formed from two 90° H-bends 11. At the forward end of the array, adjacent straight sections 10 are coupled in pairs by a 180° E-bend 16 and the lower straight waveguide sections 12 are coupled at the forward end of the array by 180° E-bends 13. The 180° E-bends are preferably low-loss Model WR-75, manufactured by Microwave Development Laboratories, of Natick, Mass. An input to the array is provided by flange 23 connecting by a 90° E-bend to feed section 22. Similarly, a terminating section 25 is provided at the far end of the waveguide run to absorb any non-radiated energy. As may now be seen with reference to FIG. 2, the continuous waveguide run represents a long straight waveguide folded and compressed into a volume having minimum dimensions to permit fitting into restricted spaces. FIG. 2 illustrates sections of the array to indicate the novel mechanical folding scheme utilized.

To radiate energy from the array, a plurality of radiating elements 14 and 15 are provided formed from short sections of rectangular waveguide closed at their rearward ends and open at their forward ends. Energy is coupled from the array waveguide into the radiating elements by small slots 17 or 19 through the wall of each radiating element and adjacent waveguide run at an appropriate point. As will be discussed in more detail hereinbelow, the amount of energy coupled is controlled by selection of the angle that each slot makes with the transverse guide axis. By careful control of such angles, an accurate amplitude distribution of electromagnetic energy radiating from the array of elements can be obtained. In FIG. 1, the slots 17 coupling radiating elements 14 to the lower straight waveguide sections 12 can be seen in the cutaway portion of element 14. Radiating elements 15, which are associated only with the upper straight waveguide sections 10, have similar feed slots 19 in the upper wall of the sections as seen in the cutaway view of upper waveguide run section 10.

As may now be recognized, electromagnetic energy is radiated from the open ends of the array of radiating waveguide elements 14 and 15. A horn 26, consisting of upper plate 27 and lower plate 28, may be utilized to provide an impedance match from the open end radiating elements to free space as is well known the art, and to produce a beamwidth of about 15° in elevation. In FIG. 3, a schematic electrical diagram is shown for the antenna. FIG. 2, which illustrates graphically the mechanical structure, shows schematically the coupling of radiating elements 14 and 15 to the waveguide sections 12 and 10, respectively.

The array illustrated by FIG. 1 is shown partially cut away to more clearly disclose the various mechanical construction features of the antenna and it is to be understood that the number of waveguide sections 10 and 12 in the waveguide run may be selected to produce the desired beamwidth of the antenna pattern. For example, in one version of the invention, the waveguide sections are formed from RG-91-U waveguide and operate in the frequency band 14.0 to 14.3 GHz. The array as shown with 30 radiating elements produces a beamwidth which varies between 4° and 8° over the total scan angle. The side lobes are about −30 dB amplitude in azimuth. The dimensions of this implementation are a depth A of 10.7", a width B of 13.5", and a thickness D of about 2.1". The horn 26 projects out 9.4" with a throat opening C of 4½". Thus, the physical size of the antenna of FIG. 1 is admirably suited to installation in the leading edge of an aircraft wing.

Before discussing additional details of the construction of the novel waveguide antenna of the invention, it is pertinent to discuss briefly the theory of operation of the sinuous waveguide antenna. The sweeping of the radar beam is achieved electronically by varying the frequency of the power source. For example, voltage tuned magnetrons and traveling wave tubes can be swept in frequency, as is well known, without the necessity of moving parts. Referring to the schematic diagram of FIG. 3, the angle which the radar beam makes with respect to the longitudinal axis of the aircraft may be expressed by the following equation:

$$\sin\theta = \frac{\lambda S}{a}\left[\frac{l}{\lambda g} - \frac{l}{\lambda go}\right];$$

where:

$\lambda$=free space wavelength of the instantaneous frequency;

S=distance along the sinuous waveguide between radiating elements of the antenna;

a=free space distance between radiating elements of the antenna;

$\lambda g$=waveguide wavelength at the instantaneous swept frequency; and $\lambda g_o$=waveguide length at center frequency.

As may be noted, for a limited variation in instantaneous frequency of the electromagnetic radiated energy, the maximum angle of sweep is controlled by the length of the waveguide sections of the antenna. In phased array antennas with wide angles of sweep, it is common for large side lobes, called grating lobes, to occur and which can cause false indications. In the present antenna, these side lobes are minimized by careful control of the distribution of radiated energy among the radiators. The amplitude of the energy coupled to the radiating element of the center of the antenna is greater than that coupled to the radiating elements at the extremes of the array of radiators. The distribution found to be optimum for the instant antenna is called a 35 dB Linear Taylor Distribution. Details of this distribution may be found in the following article:

*Design of line source antennas for narrow beam width and low side lobes,* T. T. Taylor, IEEE Transactions, Volume AT-3, PP. 16–23, January, 1955.

Figure 4:
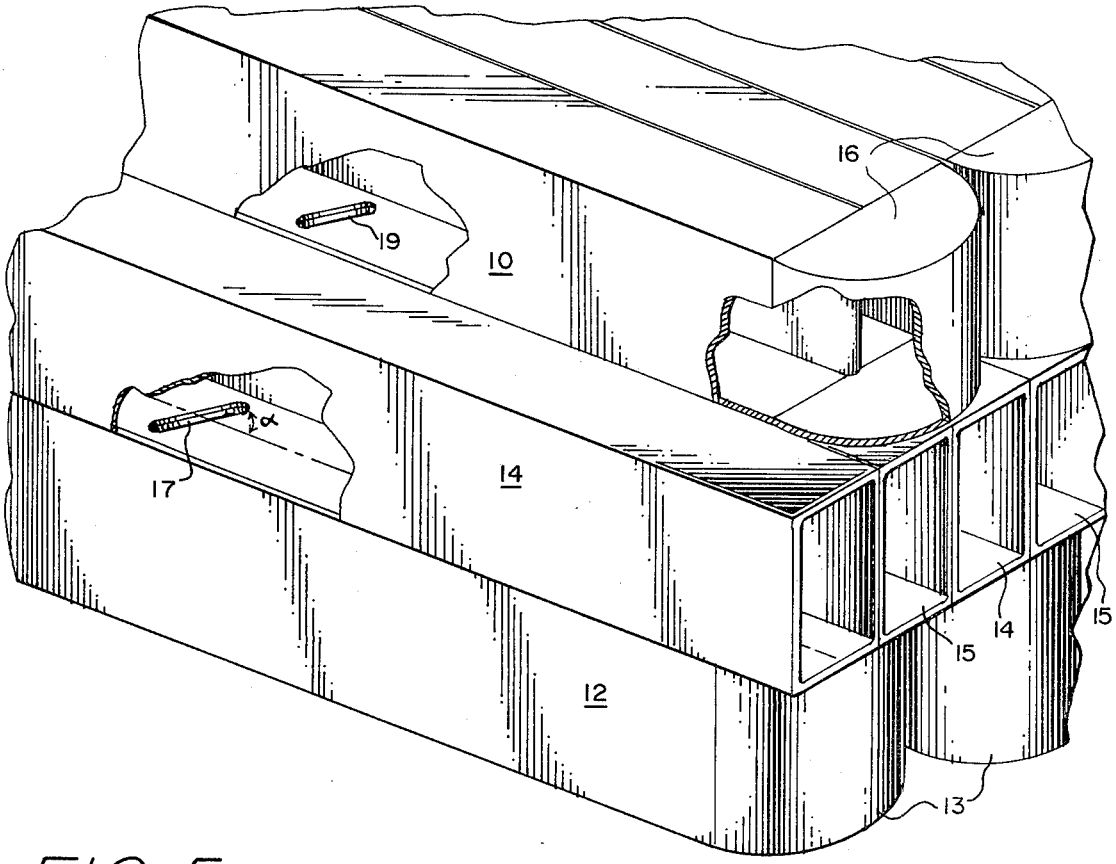
FIG. 4 is a partial and cutaway perspective view of the antenna of the invention showing the coupling between the feed waveguide and the radiating elements.

To implement the Taylor distribution, the slots 17 and 19 as shown in FIG. 4 and previously discussed have their slot angles $\alpha$ with respect to the longitudinal waveguide axis selected for each radiating element so as to produce the required amplitude of energy from that radiating element. The partial view of FIG. 4 shows radiating element 14 cut away to expose coupling slot 17 between waveguide run section 12 and radiating element 14. Similarly, coupling slot 19 between radiating element 15 and waveguide run section 10 is shown. E-bend 16 is also shown cut away. Design data for determination of coupling as a function of the angles of slots 17 and 19 may be found in the following references:

Antenna Analysis, Edward A. Wolff, John A. Wiley & Sons Publishing Co., 1966, Page 169.

*Antenna Engineering Handbook,* Henry Jasik, McGraw Hill Publishing Co., 1961, Chapter 9.

Figure 5:
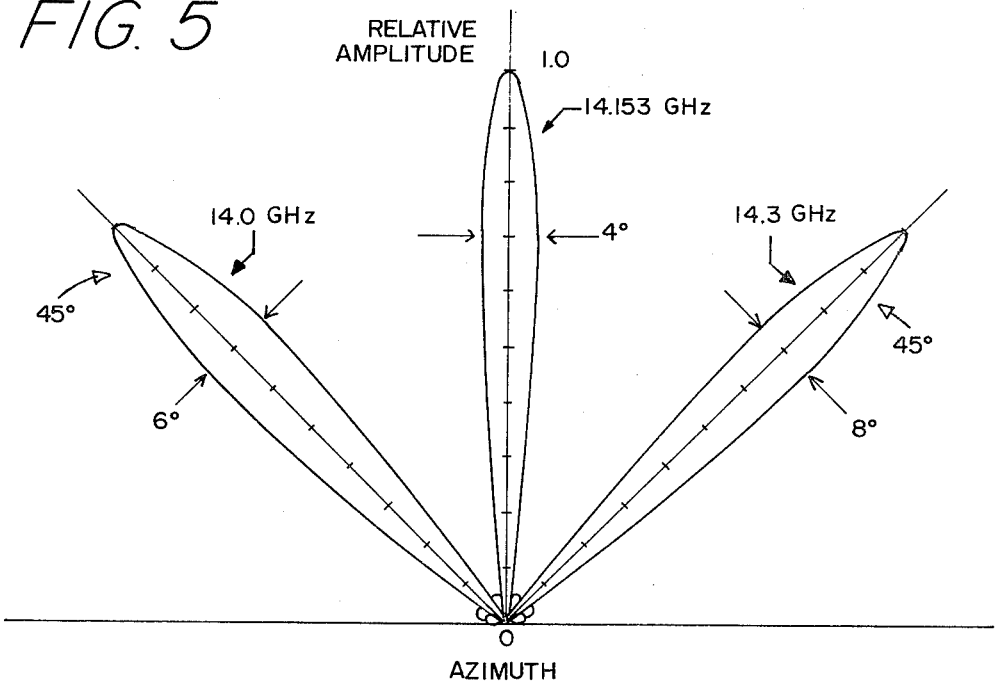
FIG. 5 is a plot showing the radiation pattern for an antenna of the invention having thirty radiating elements for 0° and ±45° azimuth headings.

An antenna as illustrated in FIG. 1 having 30 radiators 14, 15 was operated at a center frequency of 14.153 GHz which produced a very narrow beam in azimuth at a 0° heading. As the frequency swept down, the beam moved linearly to the left and, as the frequency swept toward a higher frequency, the beam moved to the right. The feed horn limited the beam to about 15° in elevation, thereby producing a fan shaped beam. In FIG. 5, three measured azimuth patterns of this antenna for 0°, and ±45° are shown when utilizing the following relative radiated energy distribution among the radiating elements:

| ELEMENT NO. | RELATIVE AMPLITUDE | ELEMENT NO. | RELATIVE AMPLITUDE | ELEMENT NO. | RELATIVE AMPLITUDE |
|---|---|---|---|---|---|
| 1 | 0.163 | 11 | 0.837 | 21 | 0.764 |
| 2 | 0.177 | 12 | 0.900 | 22 | 0.684 |
| 3 | 0.214 | 13 | 0.949 | 23 | 0.598 |
| 4 | 0.270 | 14 | 0.983 | 24 | 0.510 |
| 5 | 0.343 | 15 | 1.000 | 25 | 0.424 |
| 6 | 0.424 | 16 | 1.000 | 26 | 0.343 |
| 7 | 0.510 | 17 | 0.982 | 27 | 0.270 |
| 8 | 0.598 | 18 | 0.949 | 28 | 0.214 |
| 9 | 0.684 | 19 | 0.900 | 29 | 0.177 |
| 10 | 0.764 | 20 | 0.837 | 30 | 0.163 |

FIG. 5 shows the pattern for the center frequency of 14.153 GHz producing a 0° azimuth heading, for a frequency of 14.0 GHz producing a 45° left beam, for a frequency of 14.3 GHz producing a 45° right beam. It may be noted that the half power beamwidth varies slightly with minimum width at zero azimuth and maximum width for maximum sweep angle. Since greatest resolution of targets is desirable for line of flight, the antenna advantageously provides the narrowest beam in the center of the sweep.

ALTERNATIVE EMBODIMENT

Figures 6, 7, 8:
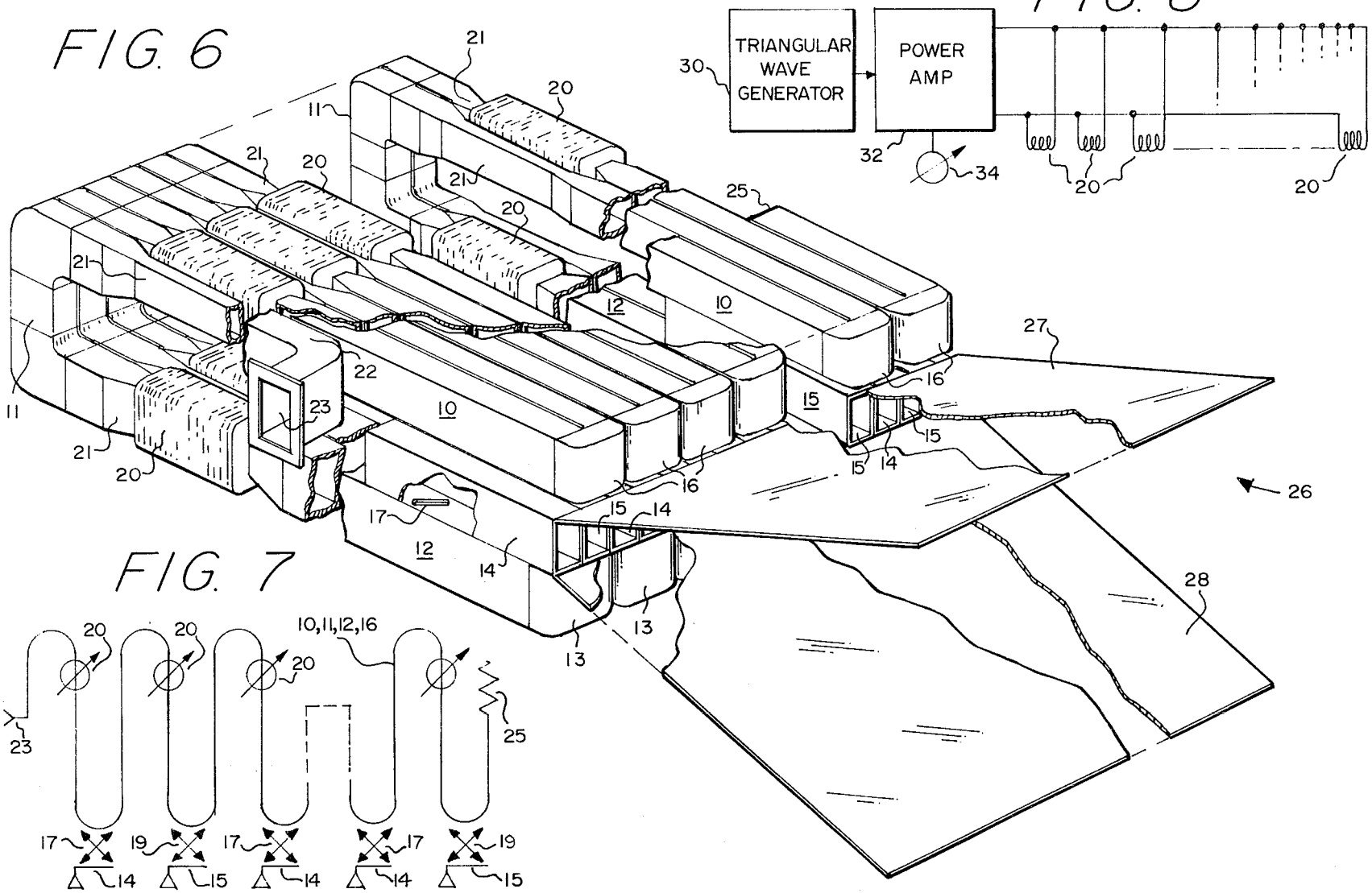
FIG. 6 is a partial and cutaway perspective view of an alternative embodiment of the invention having phase shifters to produce scanning.
FIG. 7 is an electrical schematic diagram of the antenna of FIG. 6.
FIG. 8 is a schematic diagram of the scanning circuits for use with the antenna of FIG. 6.

The preferred embodiment of the antenna is particularly advantageous due to its simplicity of construction. However, in some environments the use of a swept frequency beam is undesirable. An alternative embodiment of the novel sinuous waveguide antenna which may be utilized with a fixed frequency radar is illustrated in FIG. 6. This embodiment differs from that of FIG. 1 only by the addition of a multiplicity of ferrite phase shifters. Each upper straight waveguide section 10 and each lower straight waveguide section 12 includes a full-height to half-height transition section 21 inserted to provide space for installation of ferrite phase shifters 20. Phase shifters 20 may be of a toroidal construction with a unit installed on each pair of straight waveguide sections between each pair of radiating elements 14 and 15 as illustrated schematically in FIG. 7. The rf energy is fed to each radiator in series through the sinuous waveguide. The frequency is selected such that with no phase shift, the beam is at zero angle in azimuth. Since the rf energy is fed in series, shifting the phase of the energy of each radiator an equal amount will cause the azimuth angle of the pattern to change.

Advantageously, phase shifters 20 may be driven in parallel as shown in block diagram form in FIG. 8 from a triangular wave generator 30 and power amplifier 32. Thus, as the triangular wave varies from zero to maximum in the positive direction then back through zero to maximum in the negative direction, and thereafter back to zero, the antenna beam will be scanned linearly to the left back through the center to the right and back to the center for zero heading. The degree of scan is adjusted by means of control 34. Thus, the scanning control in the present antenna is simpler and more economical than for the more common shunt phased array antenna in which the phase of each radiator must be a multiple of that of the previous radiator requiring a more complex phasing control signal.

The phase shifters for the antenna of FIG. 4 may be a type Q-435 manufactured by Microwave Application Group, Chatsworth, Calif.

A novel, compact scannable microwave antenna has been described that is particularly suitable for installation in small aircraft. While two embodiments have been disclosed for exemplary purposes, the invention is not to be limited to these embodiments. As will be apparent to those of skill in the art, the numbers of radiating sections, the amplitude distribution of the energy radiated from the multiple radiators, the type of horn structure, the type of phase shifter and other elements may be modified for specific applications. Such changes are considered to fall within the spirit and scope of the invention.

I claim:

1. A compact, electronically scanned waveguide antenna comprising:

(1) a continuous sinuous waveguide feed structure including (a) a first bank of a selected number of straight rectangular waveguide sections horizontally disposed in parallel with the vertical broad sidewall of a section contiguous with the broad vertical sidewall of an adjacent section, (b) a second bank of said selected number of straight rectangular waveguide sections horizontally disposed in parallel having their broad vertical sidewalls contiguous, said second bank disposed immediately below said first bank a distance essentially equal to the thickness of said first bank such that each one of said straight sections of said second bank is directly below and essentially parallel with a corresponding straight section in said first bank, (c) 180° horizontal waveguide bends coupling alternate straight sections at one end of said first bank and at the corresponding end of said second bank, (d) 180° vertical waveguide bends coupling said corresponding straight sections of said first and second banks at the other end thereof;

(2) an input for receiving swept-frequency electromagnetic energy coupled to the first straight section of said first bank;

(3) a waveguide termination coupled to the last straight section of said first bank; and (4) a multiplicity of radiating elements disposed in parallel and formed from straight waveguide sections with one of said multiplicity of elements having its narrow wall contiguous with and coupled to the narrow wall of each alternate straight section in said first bank and one of said multiplicity of elements coupled to each alternate straight section in said second bank, said elements disposed between said first and second bank wherein each radiating element is parallel and contiguous to a straight section in said first and second banks thereby forming an array of contiguous open waveguide ends from which electromagnetic energy is radiated in a narrow beam in azimuth, said beam being scanned in azimuth responsive to said varying frequency.

2. The antenna as defined in claim 1 in which said radiating elements are coupled to said first and second banks by slots through said contiguous narrow sidewalls.

3. The antenna as defined in claim 2 in which the amplitude of the energy coupled through said slots is controlled by selecting the angle of said slot with respect to the longitudinal axis of said radiating elements.

4. The antenna as defined in claim 3 in which said slots are selected so as to produce a distribution of amplitudes of energy radiated from said multiplicity of radiating elements having the form of a 35 dB Linear Taylor distribution.

5. The antenna as defined in claim 4 which further comprises a vertically oriented flared horn adjacent said array of contiguous open waveguide ends of said multiplicity of radiating elements to limit said radiated electromagnetic energy to elevation.

6. The antenna as defined in claim 5 in which:

said array of radiating elements includes thirty of said elements; and said electromagnetic energy is radiated in a beamwidth having a range of about 4° to 8° in azimuth and of about 15° in elevation.

7. A sinuous waveguide transmission line for feeding a microwave antenna array comprising:

a continuous sinuous waveguide having a plurality of essentially equal length rectangular waveguide sections having parallel longitudinal axes, said sections arranged in two horizontal banks of equal numbers of said sections, the sections in each bank having their broad walls contiguous with adjacent sections, said two banks separated vertically by a distance essentially equal to the vertical dimension of said broad walls and having the lower narrow wall of each section of the upper one of said banks aligned with the upper narrow wall of each opposing section of the lower one of said bank;

a plurality of 180° E-plane waveguide bends connecting adjacent sections at the forward ends of said two banks;

a plurality of 180° H-plane waveguide bends connecting said aligned opposing sections of said banks at the rearward ends of said two banks;

an input for a source of microwave energy connected to one end of said sinuous waveguide;

a termination connected to the opposite end of said sinuous waveguide; and a plurality of coupling apertures in said continuous sinuous waveguide in which said apertures are equally spaced along said waveguide such that at a selected frequency radiated electromagnetic waves from said apertures are in phase, said apertures for feeding microwave energy to an array of radiators.

8. A sinuous microwave antenna array comprising:

a first horizontal bank of parallel rectangular waveguide sections coupled at their forward ends by 180° E-plane waveguide bends, adjacent waveguide sections having contiguous walls therebetween;

a second horizontal bank of parallel rectangular waveguide sections coupled at their forward ends by 180° E-plane waveguide bends, adjacent waveguide sections having contiguous walls therebetween, said second horizontal bank displaced vertically below said first horizontal bank an amount essentially equal to the vertical dimension of each bank;

180° H-plane waveguide bends coupling each vertical pair of parallel waveguide sections in said first and second banks at the rearward ends thereof, thereby forming a continuous folded waveguide feed structure;

a third horizontal bank of short straight rectangular waveguide radiating sections with the lengths of each section less than the lengths of the sections in said first and second banks, said third bank disposed between said first and second banks with said short waveguide sections parallel with said straight sections and aligned therewith, the rearward ends of said short radiating sections being electrically short-circuited, the forward ends of said short radiating sections being open and aligned in an array of radiators;

coupling means between said third bank and said first bank and between said third bank and said second bank; and an input to said continuous folded waveguide feed structure, said input receiving microwave energy have a swept frequency;

whereby the electromagnetic waves radiating from said array of radiators are in such phase relationship so as to produce a beam narrow in azimuth and said swept frequency input causes said narrow beam to scan in azimuth.

9. A scannable microwave antenna comprising:

a plurality of straight rectangular waveguide radiating sections having parallel longitudinal axes, said sections arranged in a bank having their broad walls contiguous with adjacent sections and with open output ends aligned for radiation of microwave energy;

a pair of flat plates disposed along the upper and lower narrow wall edges of said open output ends to form a flared horn to limit the beamwidth of such radiated microwave energy in the H-plane;

a waveguide feed for said radiating sections comprising a continuous sinuous waveguide having an input at one end thereof for receiving microwave energy and a termination at the other end thereof, the narrow walls of a first bank of straight sections of said waveguide contiguous with the narrow walls of said bank of radiating sections and a narrow wall of a second bank of straight sections of said waveguide contiguous with the opposite narrow walls of said bank of radiating sections; and coupling apertures between first alternate straight sections of said first bank of straight sections and said contiguous radiating sections, and between second alternate straight sections of said second bank of said straight sections non-opposing the said first alternate straight sections and said contiguous radiating sections;

whereby the phase relationships between the microwave energy radiated from each of said open output ends produces a beam which is narrow in the E-plane and which can be scanned by variations of the phases of the radiation from said radiating sections.

10. The antenna as defined in claim 9 in which said input received microwave energy varies linearly in frequency over a preselected range thereby causing said variation of the phases of the radiation from said radiating sections.

11. The antenna as defined in claim 9 which further comprises a phase shifter disposed along said waveguide feed ahead of each of said coupling apertures.

12. The antenna as defined in claim 9 which further comprises:

a pair of full-height to half-height transition sections disposed in each of said straight sections of said first and second banks; and a ferrite phase shifter disposed around each of said pair of transition sections which are ahead of said coupling apertures.

13. The antenna as defined in claim 11 or 12 which further comprises an electrical current source connected in parallel to each of said phase shifters, said current source producing a time varying intensity current in said phase shifters, whereby said phase shifters responsive to said varying current to cause said variations of the phase of the radiation from said radiating sections.

14. The antenna as defined in claim 13 in which said current source produces a triangular wave.

* * * * *